United States Patent [19]

Warde

[11] 4,344,805

[45] Aug. 17, 1982

[54] ARTIFICIAL FLOWER MAKING TEMPLATE AND METHOD

[76] Inventor: Suzanne M. Warde, 424 Ninth Ave., Lindenwold, N.J. 08021

[21] Appl. No.: 257,399

[22] Filed: Apr. 24, 1981

Related U.S. Application Data

[62] Division of Ser. No. 131,054, Mar. 17, 1980, abandoned.

[51] Int. Cl.[3] ..... A41G 1/00

[52] U.S. Cl. ..... 156/61; 428/24

[58] Field of Search ..... 428/4, 24; 156/61

[56] References Cited

U.S. PATENT DOCUMENTS

| | | | |
|---|---|---|---|
| 2,529,413 | 11/1950 | Petersen | 434/83 |
| 2,697,892 | 12/1954 | Haas | 428/24 X |
| 2,949,681 | 8/1960 | Knefeli | 434/191 |
| 3,833,157 | 9/1974 | Lofton | 428/4 X |

*Primary Examiner*—Henry F. Epstein

*Attorney, Agent, or Firm*—Bertram Frank

[57] ABSTRACT

An artificial flower making method is provided in which realistic looking pom-pon type flowers are fashioned from a single strand of yarn or twice, suitably of the heavy knitting yarn type, by first arranging a portion of the yarn on a novel notched circular template to form six or other even number of yarn spokes, spirally weaving and interlocking the remainder of the yarn with said spokes from the center outward to cover a major portion of the area of said template, joining the starting and finishing ends of the yarn to each other and to a deformable stem member at the center of said template, cutting the yarn portions at the center of the reverse side of the template to thereby release the woven assemblage from the template, and inverting the woven assemblage by bringing said reverse side cut yarn portions around to, and joining them to said stem member, whereby the side of the woven assemblage which had been adjacent the template bulges outwardly to a puffed pom-pon like configuration. When the yarn and stem assemblage is wrapped with florest green tape and interwrapped with appropriate artificial leaves, the resulting artificial flower is suitable for many type floral arrangements.

The novel template can comprise a simple rigid flat sheet of essentially circular contour having six or other even number of equally spaced notches in its outer perimeter having a depth somewhat greater than the diameter of the yarn being used, and an aperture or other characterizing means indicating the geometric center of the template. In a preferred adaptation the working side of the template will have slightly raised center and peripheral edge portions to support the yarn spokes in slightly spaced relation to the surface of the template.

3 Claims, 8 Drawing Figures

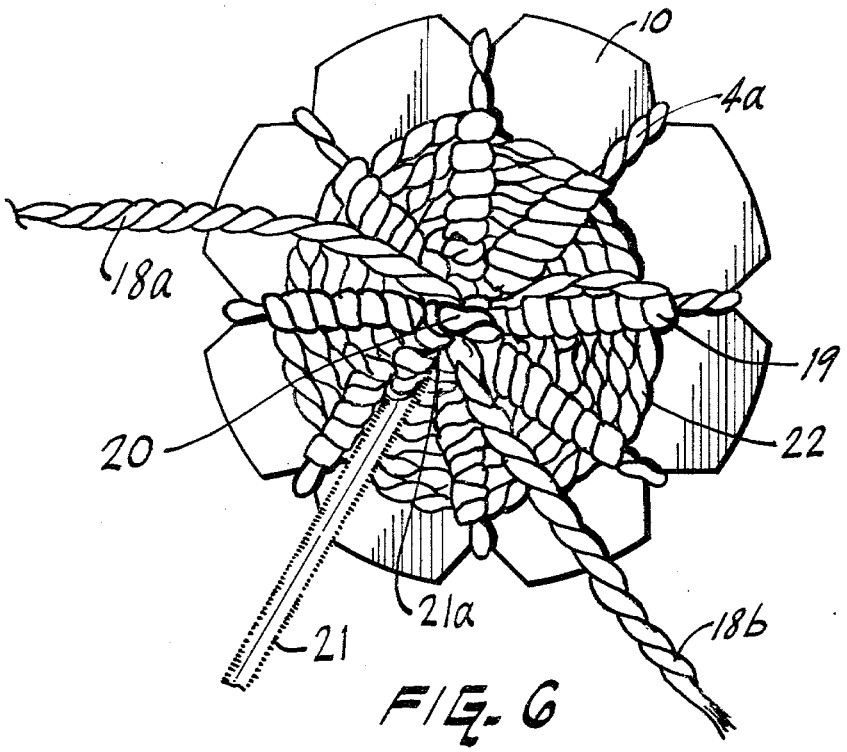
FIG. 6
FIG. 7
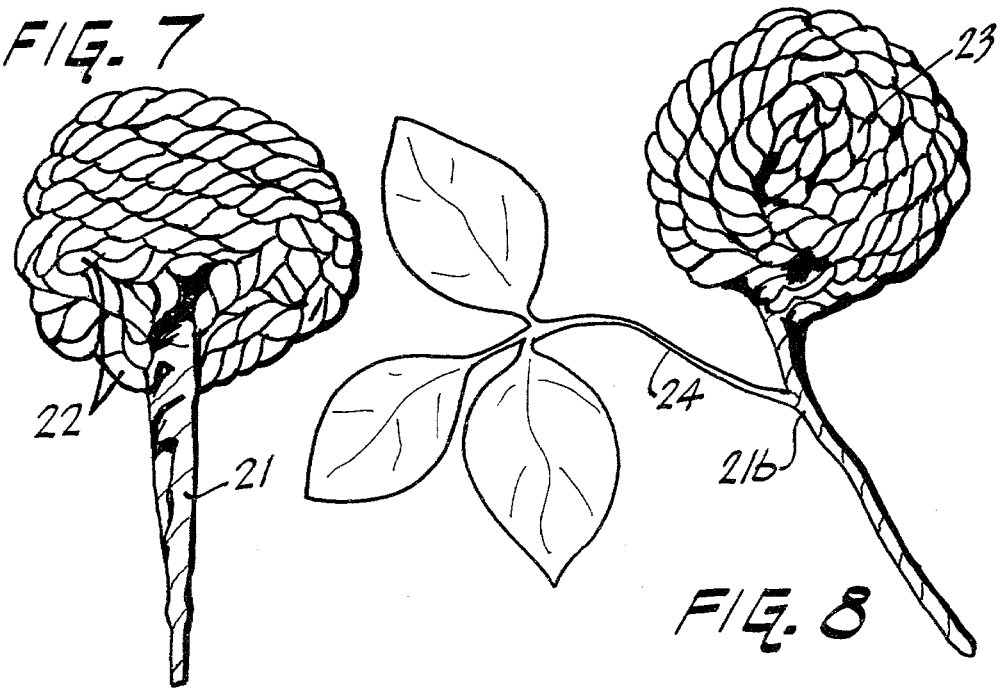
FIG. 8

ARTIFICIAL FLOWER MAKING TEMPLATE AND METHOD

This is a division of application Ser. No. 131,054, filed Mar. 17, 1980 and now abandoned.

This invention relates to a method of fashioning from yarns and twines of varying types and diameters artificial flowers of pom-pon like appearance appropriate for use in various type floral arrangements, and to the template used in carrying out the method.

It is known that fabrics and yarns have long been used in the fashioning of ornamental bodies of flower-like appearance, but applicant has no knowledge concerning previously available methods utilizing the approach and attaining the novel effects of the present invention. While the method could conceivably be carried out by an appropriately programmed automatic machine, it is primarily intended as a home-craft type method permitting invalids and others to utilize time in an interesting and productive way. Indeed, the method evolved through experimentation into ways of providing interest and productivity during therapeutic exercising of arthritic fingers.

The method of fashioning artificial flowers in accordance with the present invention utilizes a generally round flat rigid template having six or other even number of equally spaced notches circumferentially thereof around which yarn is first wrapped, with rotation of the template, to provide yarn spokes entwined around a short starting yarn end at the working side of the template and crossing each other at the center of the reverse side. The longer yarn end is then spirally laced on the yarn spokes at the working side by passing under two spokes, back over the second, under it and the next, back over said next, etc., until a plurality, of spirals, suitably about 6 to 9 have been completed extending outwardly from the center of the spoke area. Then after looping around the last spoke the working end and the short yarn end are tied to each other and to an elongated deformable stem forming member at the center of the spoked area. The yarn strands at the reverse side of the template are then cut at the center, the free ends are brought around to meet the stem forming member and are wrapped around the same in a manner to bring the edges of the spirally woven mat as close as possible to the stem forming member, thereby forming a bulbous pom-pon like mass closely simulating a natural flower. The template can be a flat rigid member suitably with smoothly rounded edges, but preferably is provided at the working side with a slightly raised center and similarly raised peripheral edge to provide clearance for freely passing yarn under the spokes in the weaving operation.

The number of template notches and spokes is preferably eight although numbers as low as six and as high as twelve can be employed in varying the size and appearance of the artificial flowers produced.

The size yarn employed in the method can also be varied widely. Heavy knitting yarns and the heavier arts and crafts yarns are particularly suitable for producing artificial flowers approximately 2 to 2½ inches in diameter. It will be understood, however, that any flexible strand material can be used to vary the size and ornamental effect of the artificial flowers. For those liking to do delicate work the use of finer yarn or even crochet type thread will produce very small bodies having the characteristic flower like configurations induced by the weaving process. When substantially larger artificial flowers are desired, twine or rope of suitable size and flexibility can be used in place of yarn.

When the yarn to be used is of the heavy knitting and art craft type a template about 4½ inches in diameter is appropriate. When intended for use with finer yarns the template size could be the same or appropriately reduced. As larger strands of twine or rope are used, however, a template of appropriately larger diameter should be employed. As a point of reference, when using a 4½ inch template having eight notches and three ply knitting yarn, the weaving of 6 to 9 spirals will produce and artificial flower about 2 inches to 2½ inches in diameter.

The weaving of yarn or twine around the spokes is facilitated by using a conventional, large-eyed needle, suitably fashioned from flexible plastic. While the method can be carried out quite satisfactorily with yarn spokes arranged on a flat template, it is somewhat slow and tedious to have to feed the needle and yarn between the closely engaged spokes and template. This can be overcome, however, by employing a template which is molded or otherwise formed to have a slightly raised center and similarly slightly raised peripheral edge which follows the notched contour of said edge. This provides clearance between the spokes and the body of the template so that needle and yarn or twine can be easily passed beneath the spokes in the weaving operation. Flower heads produced by this method can be finished off with a wrapping of florest green tape or the like with intertwined artificial leaves if desired to produce attractive single flowers as well as multiple flower arrangements on a single stem.

The new method and template in accordance with the present invention will be more fully understood from a consideration of the following description having reference to the accompanying drawings in which the several views illustrate preferred adaptation of the invention and details of the weaving method and in which:

FIG. 6 is a plan view of the template and associated yarn at completion of the weaving stage and showing the stem member attached.

FIG. 7 is a view of the underside of the woven assemblage after severing yarn strands at the reverse side of the template and uniting them with the stem member; and FIG. 8 is a top view of the completed flower.

Figure 1:
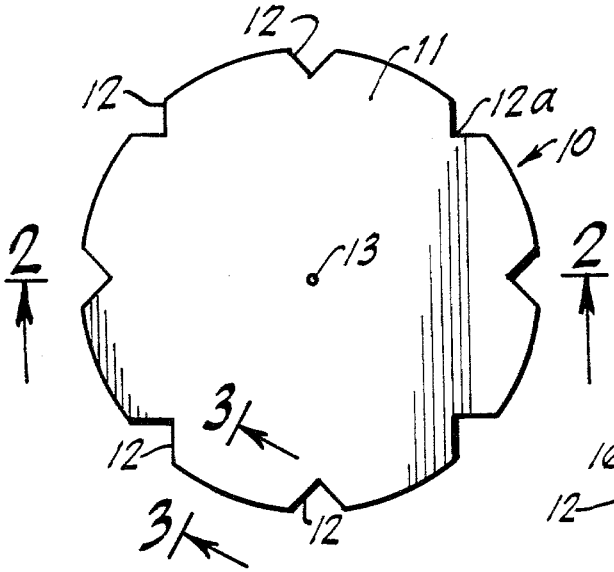
FIG. 1 is a plan view of the template for use in the method.
Figure 2:
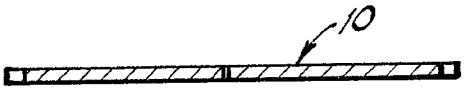
FIG. 2 is a sectional view substantially on the line 2—2 of FIG. 1.

As shown in FIGS. 1 and 2 of the drawings, a simple template 10 in accordance with the present invention comprises a flat sheet 11 of cardboard, plastic or other relatively rigid, lightweight material of generally circular contour having an even number of notches 12 equally spaced circumferentially thereof. The notches 12 should be of a depth substantially greater than the diameter of the yarn to be used with the template and should preferably terminate in rounded ends 12*a* to minimize damage to the yarn. The template 10 is preferably provided with a small aperture 13 and other indicating means at the geometric center to aid the user in maintaining a symmetrical yarn pattern.

Figure 3:
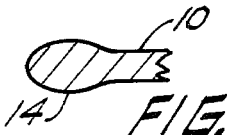
FIG. 3 is an enlarged fragmentary view substantially on the line 3—3 of FIG. 1.

While the template 10 may be of uniform thickness as shown in FIG. 2, it is desirable, particularly when fashioning the device from molded plastic, to provide a slightly beaded contour 14 at peripheral edge portions as shown at FIG. 3. Such beaded edge portions would follow the complete periphery including the outlines of the notches 12.

Figure 4:
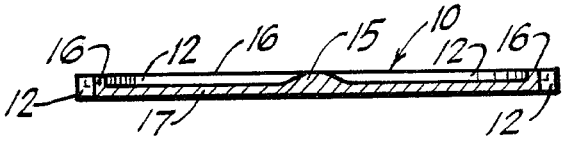
FIG. 4 is a sectional view similar to FIG. 2 showing a modified template construction.

A preferred form of the device as shown in FIG. 4, which is readily fashioned from molded plastic, is provided at the top or working side of the device with a slight central projection 15 and a narrow projection 16 of similar height extending around the perimeter including the outlines of the notches 12. As will be more fully apparent from the following discussion, the raised portions 15 and 16 will support the yarn spokes as applied to the template 10 in spaced relation to the body portion 17 thereby facilitating passing a working yarn strand under the yarn spokes in the weaving operation.

As shown in the drawing, the template 10 is provided with eight notches 12 providing the eight spoked arrangement of yarn on the template. This, however, is merely illustrative and it should be understood that other even numbers of notches such as six, ten or twelve can be employed to modify the weave and appearance of the artificial flowers being produced.

Figure 5:
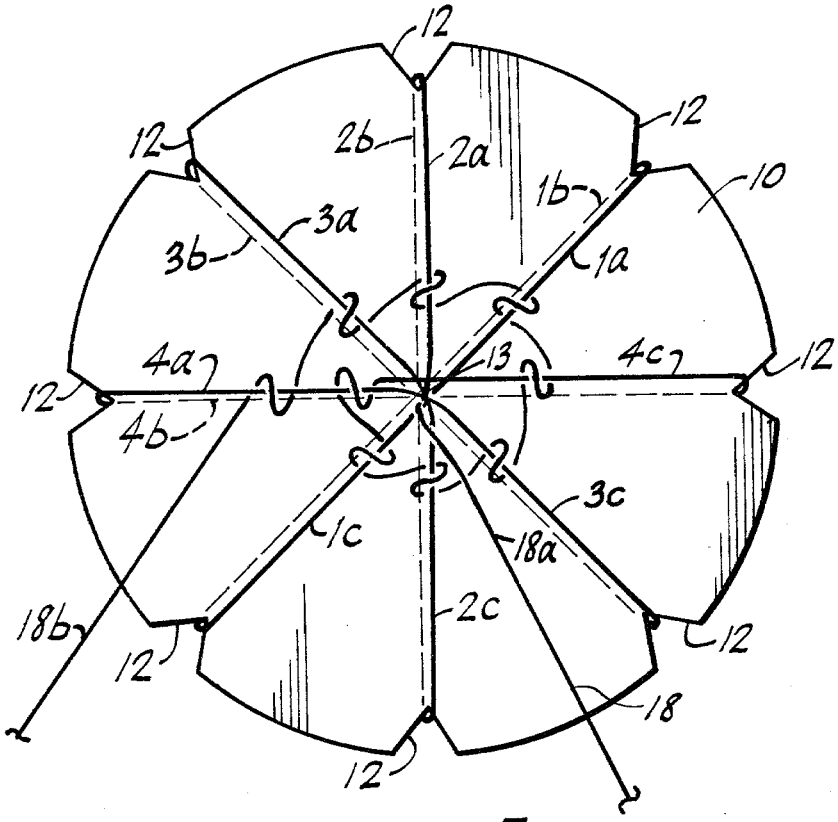
FIG. 5 is a view similar to FIG. 1 diagramatically illustrating application of yarn to the template and an initial phase of the weaving operation as seen from the working side of the template.

The manner of applying yarn 18 to the template 10 and initiating the weaving operation is believed to be best understood from considering the diagramatic showing in FIG. 5. A piece of yarn 18 is selected having sufficient length to complete the desired weave and is grasped at one, starting end in a manner to be supported at the geometric center 13 of the template with a few inches hanging free as indicated by the legend "starting end" and by the numeral 18*a*. The working end 18*b* of the yarn is then fed along path 1*a* down through a notch 12 along path 1*b* at the reverse side of the template 10 and through a diametrically opposed notch 12 and returned along 1*c* to the geometric center 13. Here it is turned through a small angle around starting end 18*a* and then passed along path 2*a* downwardly through the next notch 12 diametrically across the back of the template along line 2*b*, upwardly through opposed notch 12 and back to the geometric center along 2*c*. This procedure is continued applying yarn along routes 3*a, b* and *c* and 4*a, b* and *c* to complete a lay of eight spokes which are entwined at the front or working end of the template 10 but merely cross each other at the reverse side of the template. As the working end 18 is moved along path 4*c* to the geometric center 13 it is passed under, around and under spoke 4*a* to 1*c*, under, around and under 1*c* to 2*c* and is similarly advanced to spokes 3*c*, 4*c*, 1*a*, 2*a*, 3*a* and 4*a* as clearly seen from the diagramatic showing, at which point a first row of spiral weaving will have been completed. It will be understood that in the actual weaving the working end of yarn 18*b* will be drawn quite tightly around each spoke and close to the geometric center as the weaving proceeds and then spacing outwardly from the geometric center 13 in FIG. 5 of the drawings is merely to permit a clear understanding of the weaving pattern and sequence.

FIG. 6 of the drawing illustrates a completely woven mat in which the working end 18*b* has been passed around and interwoven with the yarn spokes seven times in the manner above described with the weave terminating at spoke 4*a*. Then yarn is passed once around spoke 4*a* as seen at 19 and is tied at 20 to the short end 18*a* and to the hooked end 21*a* of a pipe cleaner or other deformable stem forming member with the juncture 20 being substantially at the geometric center 13 earlier described.

After attaching the stem forming member 21 the yarn at the reverse side of the template 10 forming crossed spokes 1*b*, 2*b*, 3*b* and 4*b* are cut at approximately the geometric center 13 and brought around to the stem forming member 21 and wrapped around the same to bring peripheral edges 22 of the woven mat close to the stem member 21 as shown in FIG. 7. This imparts to the woven mass a puffed, pom-pon like contour which, as viewed from the top as seen at FIG. 8, provides an intricate spiral contour 23 having an attractive and flower-like appearance. Wrapping the stem with florist tape 21*b* securely anchors the woven assemblage, as well as artificial leaves 24, to the stem 21 forming a durable artificial flower spray appropriate for many floral arrangements.

Various changes and modifications in the weaving method and template for forming artificial flowers as herein disclosed may occur to those skilled in the art, and to the extent as such changes and modifications are embraced by the appended claims it is to be understood that they constitute part of the present invention.

I claim:

1. A method of fashioning artificial flowers from yarn or twine comprising providing an essentially circular template of flat, rigid material having six or other even number of notches equally spaced circumferentially thereof, providing a unitary strand of yarn or twine having a length at least sufficient to complete the formation of a planned artificial flower, wrapping said strand, with a short starting end supported at the geometric center of one, working side of the template, around said template with rotation of the template to provide strand spokes entwined around said starting end of the working side of the template and crossing each other at the center of the reverse side, then spirally lacing said strand around the spokes at said working side by passing the strand under two spokes, back over the second, under it and the next, back over said next and under two, etc., until six or more complete spirals have been completed, then, after looping the strand around the last strand spoke, tieing it at the geometric center of the template to said starting end to a deformable stem-forming member, then cutting the crossed strand spokes centrally of the reverse side of the template, bringing the cut ends around to and joining the stem-forming member in a manner to bring edges of the spirally woven mat as close as possible to the stem forming member, and wrapping together said cut ends and stem forming member to provide a permanent assemblage wherein the woven mat has been converted to a bulbous, pom-pon-like mass closely resembling a natural flower.

2. The method of fashioning artificial flowers as defined in claim 1 wherein the template employed has eight equally spaced peripheral notches, the strand material is three-ply knitting yarn, the spiral weaving of strand material is continued through about six to nine complete spirals to thereby produce pom-pon-like artificial flowers having diameters in the general range of about 2 inches to 2½ inches.

3. The method of fashioning artificial flowers as defined in claim 1 wherein said stem forming member and entwined cut ends of strand material are wrapped with florist tape with artificial leaves appropriately positioned on said stem forming member to thereby provide a flower spray appropriate for many floral arrangements.

* * * * *